US005423696A

United States Patent [19]

Sato

[11] Patent Number: 5,423,696

[45] Date of Patent: Jun. 13, 1995

[54] SHIELD CONNECTOR

[75] Inventor: Shigeru Sato, Kawasaki, Japan

[73] Assignee: Yamaichi Electronics Co., Ltd., Tokyo, Japan

[21] Appl. No.: 139,831

[22] Filed: Oct. 22, 1993

[30] Foreign Application Priority Data

Oct. 22, 1992 [JP] Japan ..... 4-308312

[51] Int. Cl.[6] ..... H01R 13/652

[52] U.S. Cl. ..... 439/607; 439/567; 439/108

[58] Field of Search ..... 439/607-610, 439/95, 98, 108, 567, 740

[56] References Cited

U.S. PATENT DOCUMENTS 4,874,336 10/1989 Marsh ..... 439/607
5,108,312 4/1992 Sampson ..... 439/607
5,192,228 3/1993 Collins et al. ..... 439/607
5,249,974 10/1993 Wang ..... 439/607

FOREIGN PATENT DOCUMENTS 1-63082 4/1989 Japan .

*Primary Examiner*—David L. Pirlot
*Assistant Examiner*—Hien D. Vu
*Attorney, Agent, or Firm*—Wenderoth, Lind & Ponack

[57] ABSTRACT

A shield connector has a metal shell fitted onto one end of a connector body. The one end of the connector body is provided with a metal grounding piece adapted to connect the metal shell to a wiring board. The metal shell is provided with a receiving port for receiving the metal grounding piece. A short claw formed on the metal grounding piece is pressure-inserted into the receiving port in order to provide an electrical connection between the metal shell and the metal grounding piece.

7 Claims, 6 Drawing Sheets

SHIELD CONNECTOR

BACKGROUND OF THE INVENTION

1. Field of the Invention

This invention relates to a shield connector having a metal shell fitted onto a connector body thereof, and more particularly to a shield connector further having a grounding metal piece for connecting the metal shell to a wiring board.

2. Brief Description of the Prior Art

As disclosed in Japanese Laid-Open Utility Model Application No. Hei 1-63082, there is known a shield connector comprising a connector body, a metal shell fitted onto the connector body, and a grounding metal piece which is firmly connected, together with the connector body, to the metal shell by a screw means or a stud means such as a metal eyelet.

Since the screw means or stud means are essential in the conventional shield connector to connect the grounding metal piece to the metal shell, the number of component parts of the conventional shield connector is increased, and much time and labor is required for tightening the screw means, etc., which all result in an increase in cost. Moreover, insufficient tightening of the screw means, etc. often causes an insufficient shielding. These shortcomings decrease the reliability of the conventional shield connector.

SUMMARY OF THE PRESENT INVENTION

It is therefore an object of the present invention to provide a shield connector in which a grounding metal piece can be easily and reliably connected to a metal shell without using a screw means or a stud means.

According to the present invention, there is provided, in order to achieve the above object, a shield connector having a metal shell fitted onto one end of a connector body, the one end being provided with a grounding metal piece adapted to connect the metal shell to a wiring board, wherein the metal shell is provided with a receiving port for receiving the grounding metal piece, and a short claw formed on the grounding metal piece is pressure-inserted into the receiving port in order to provide electrical connection between the metal shell and the grounding metal piece.

The metal shell may be provided with a clamper means. A receiving port for receiving the shield metal may be formed between clamping elements of the clamper means.

From other aspect of the invention, there is also provided a shield connector having a metal shell fitted onto one end of a connector body, the one end being provided with a grounding metal piece adapted to connect the metal shell to a wiring board, wherein a receiving port is formed in an interface between the metal shell and the connector body, and the short claw formed on the grounding metal piece is pressure-inserted into the receiving port in order to provide an electrical connection between the shell and the grounding metal piece.

DETAILED DESCRIPTION OF THE EMBODIMENT

Figure 1:
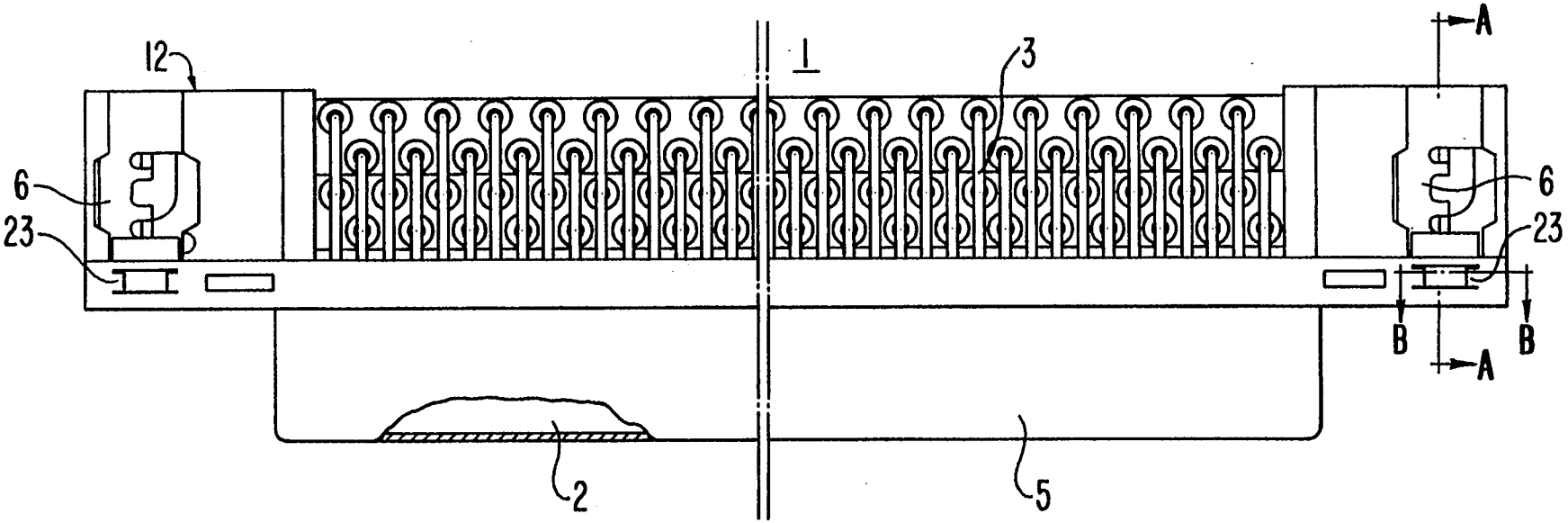
FIG. 1 is a plan view of a shield connector according to one embodiment of the present invention.
Figure 2:
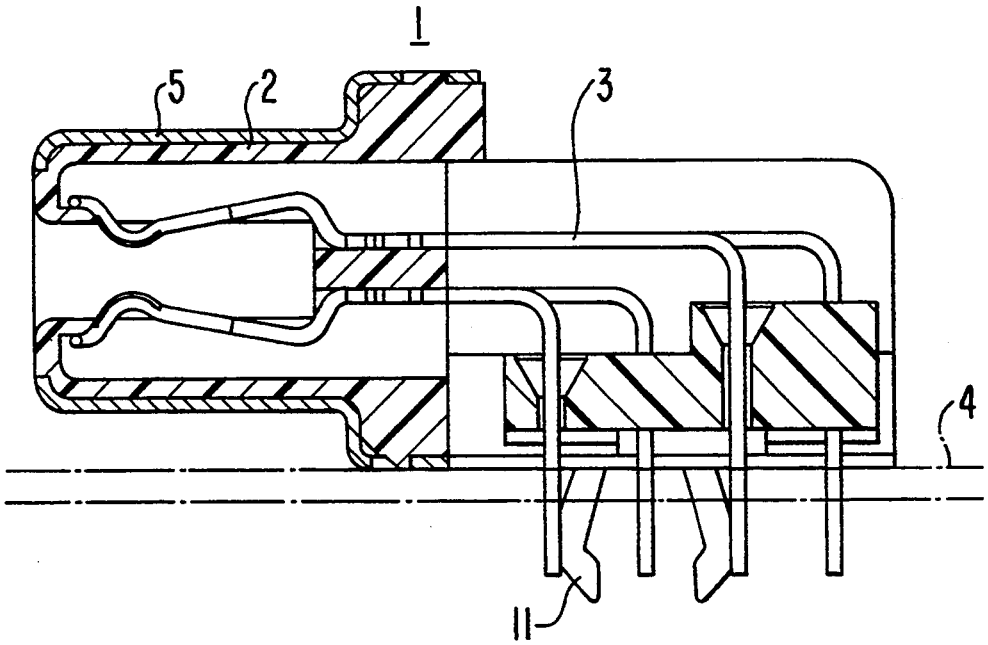
FIG. 2 is a sectional view of the above shield connector.
Figure 3:
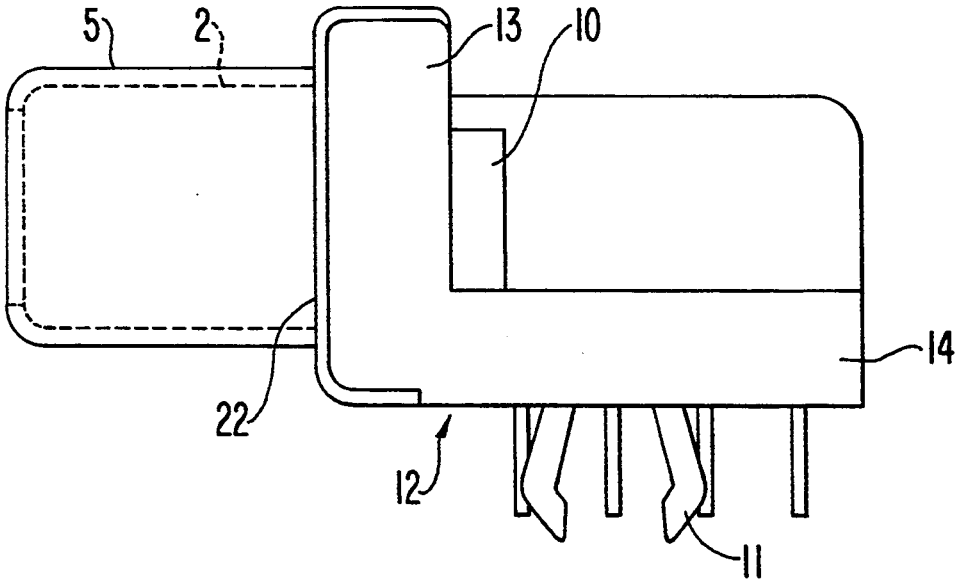
FIG. 3 is a side view of the above shield connector.
Figure 4:
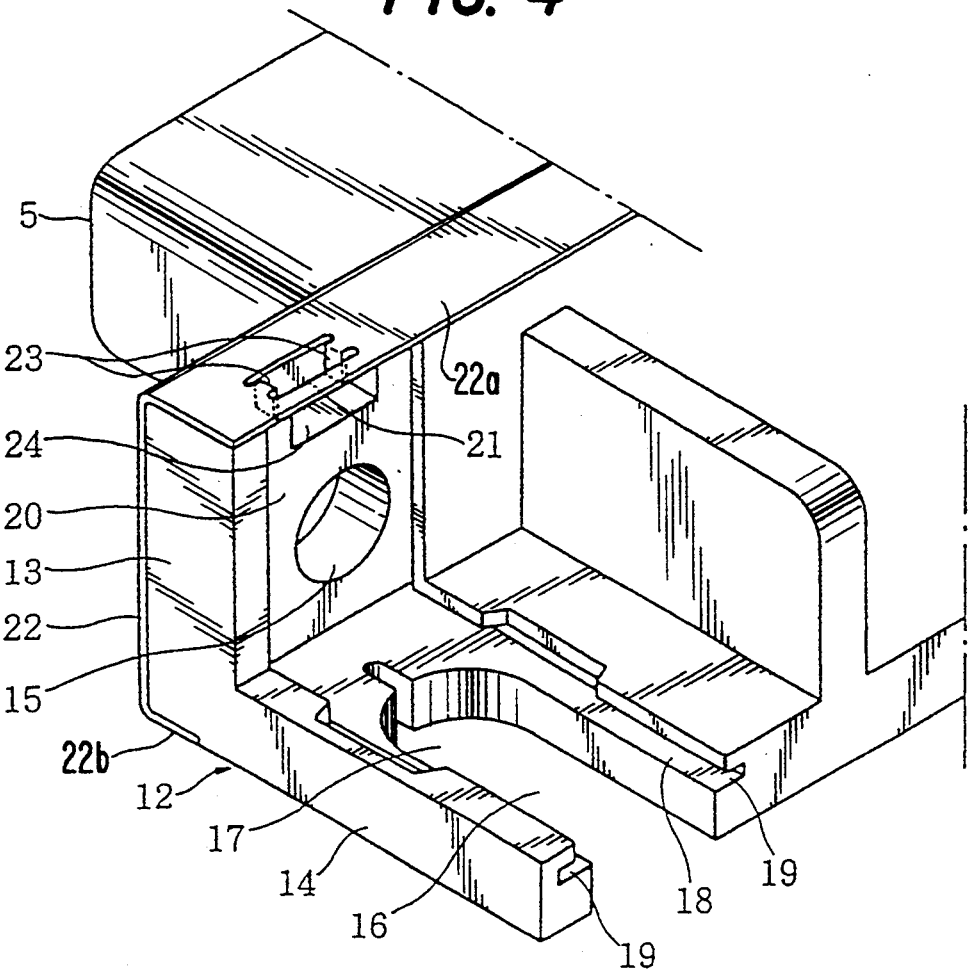
FIG. 4 is a perspective view of a grounding metal piece mounting portion of the above shield connector.
Figure 5:
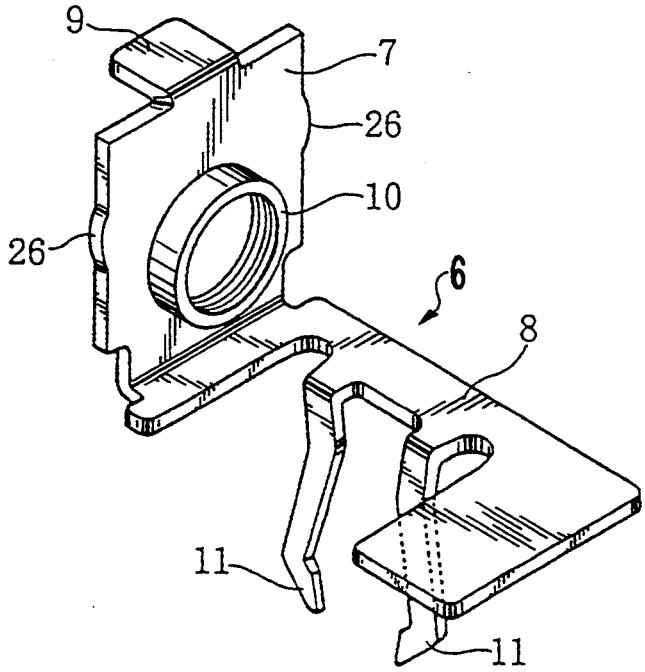
FIG. 5 is a perspective view of a grounding metal piece.
Figure 6:
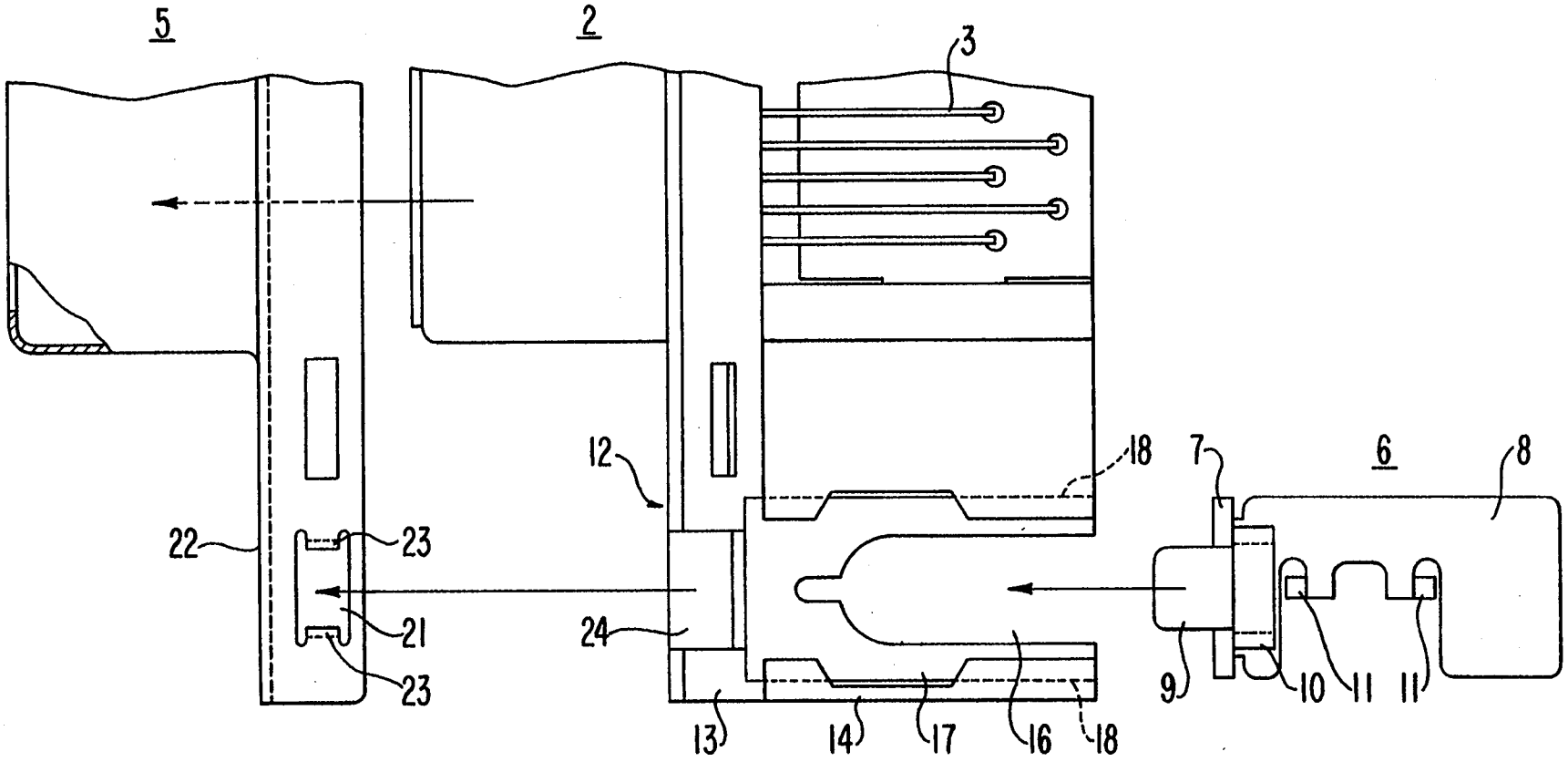
FIG. 6 is an exploded plan view of an important portion of the above shield connector.
Figure 7:
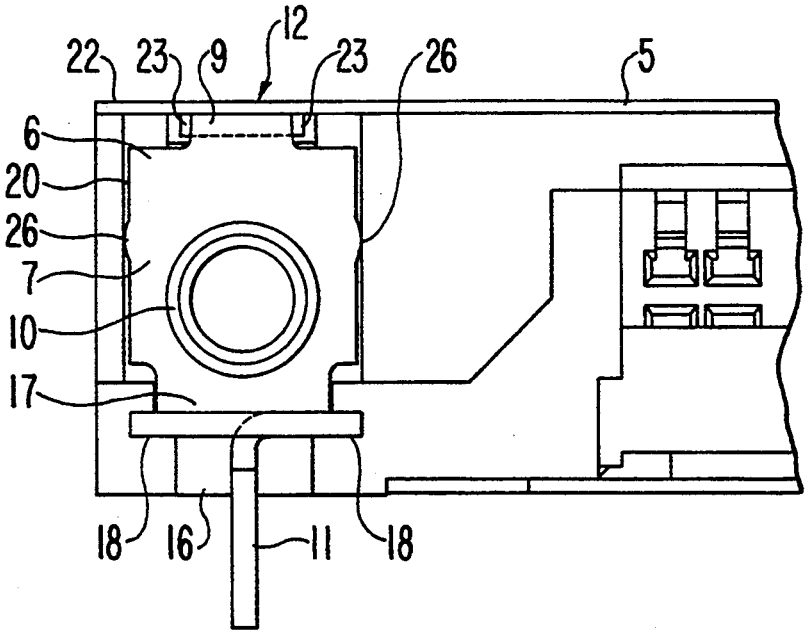
FIG. 7 is a bottom view of an important portion of the above shield connector.

A shield connector according to one embodiment of the present invention will be described in detail with reference to FIGS. 1 to 10 of the accompanying drawings which are incorporated in and constitute a part of the specification.

Reference number 1 denotes a shield connector assembly. This shield connector assembly 1 is provided within a connector body 2 with a plurality of contacts 3, first ends of which are connected to connectors of other devices and instruments and second ends of which are connected to a printed circuit board (wiring board) 4.

A metal shell 5 is fitted onto the connector body 2 in such a manner as to enclose the connector body therein. Mounted respectively on opposite ends of the connector body 2 are metal grounding pieces 6 which are adapted to connect the metal shell 5 to the wiring board 4.

Each of the metal grounding pieces 6 has a mounting plate 7 and a grounding plate 8 which are connected to each other in such a manner as to form the shape of a letter L. The hook-like short claw 9 is formed on one end of the mounting plate 7. A cylindrical sleeve 10 with a female thread formed in an inner surface thereof is formed on the mounting plate 7 by burring. In FIGS. 1 through 8, the grounding plate 8 has a pair of grounding legs extending downward (in FIG. 5) in parallel.

Figure 10:
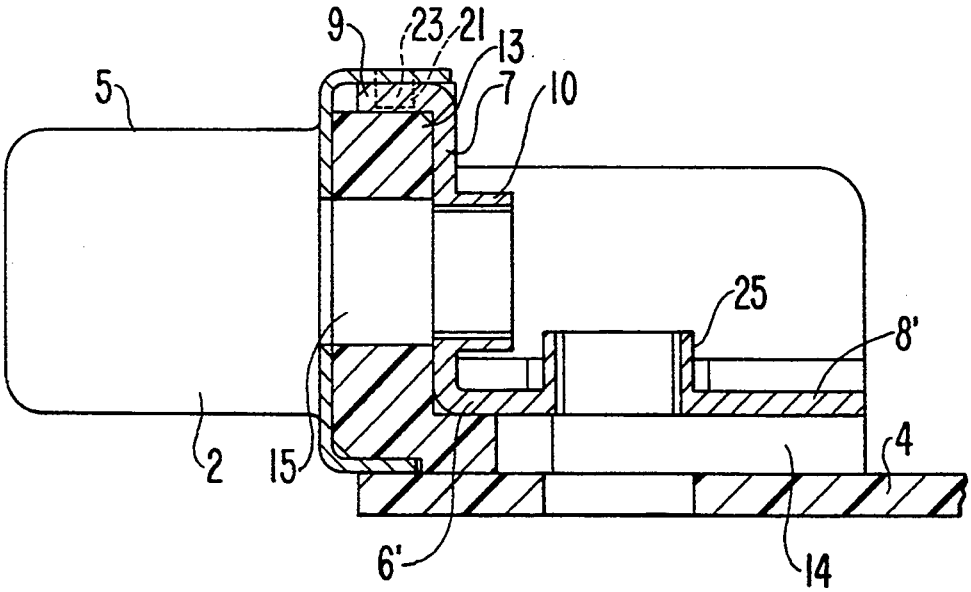
FIG. 10 is a sectional view similar to FIG. 8, but showing a modified form of the embodiment.

FIG. 10 shows a metal grounding piece 6' which is modified relative to the metal grounding piece 6' and in which a plate 8' is not provided with the grounding legs 11. Instead of the grounding legs 11, a cylindrical sleeve 25 formed with a female thread is formed on the grounding plate 8 by burring, and the metal grounding piece 6' is tightened to the wiring board 4 by a male-threaded member being engaged in the female-threaded cylindrical sleeve 25.

The connector body 2 is provided with generally L-shaped mounting seats 12 each protruding sideways from each of the opposite ends of the connector body. One component element of each generally L-shaped mounting seat 12 forms a supporting seat 13 extending along the mounting plate 7 of the metal piece 6, and the other component element forms a supporting seat 14 extending along the grounding plate 8 of the metal piece 6.

As a means for reliably holding the metal grounding piece 6 in a predetermined position of the mounting seat 12, an engagement portion 17, in which the grounding plate 8 of the metal grounding piece 6 engages, is formed in a seat surface of the supporting seat 14. A pair of engagement grooves 18 are formed in opposing inner surfaces of the engagement portion 17 substantially at a level of the seat surface. Opposite edges of the grounding plate 8 are engaged in and held by the engagement grooves 18. First ends of the engagement portion 17 and engagement grooves 18 are opened at an end face of the supporting seat 14. The grounding plate 8 is inserted into the engagement grooves 18 through the open ends 19 thereof, with the mounting plate 7 side being inserted first. An engagement portion 20, which the mounting plate 7 engages, is formed at a seat surface of the supporting seat 13 in such a manner as to be in alignment with the first-mentioned engagement portion 17.

The L-shaped metal grounding piece 6 is fitted into the L-shaped mounting seat 12, and the mounting plate 7 of the grounding metal piece 6 is placed along the supporting seat 13 of the mounting seat 12. The short claw 9 of the mounting plate 7 is placed along an end face of the supporting seat 13 so as to be subjected to pressure-insertion as will be described later. A mounting hole 15, which communicates with the threaded cylindrical sleeve 10, is formed in the supporting seat 13 with the mounting plate 7 placed therealong and further in the metal shell 5. At the same time, the grounding plate 8 of the metal grounding piece 6 is placed along the supporting seat 14 of the mounting seat 12. A grounding leg insertion hole 16 is formed in the supporting seat 14, i.e., a bottom of the engagement portion 17. The grounding legs 11 are inserted through the insertion hole 16 in such a manner as to extend outwardly of the supporting seat 14, and the extending grounding legs 11 are subjected to pressure-insertion and soldering in a through-hole formed in the wiring board 4. Lugs 26 formed on opposite edges of the mounting plate 7 are pressure-inserted into the engagement portion 20 and secured against inner side walls of the engagement portion 20 upon insertion of the metal grounding piece 6.

The metal shell 5 is provided with a receiving port 21 for receiving the metal grounding piece 6. The short claw 9 formed on the grounding metal piece 6 is pressure-inserted into the receiving port 21 to provide electrical connection between the metal shell 5 and the grounding metal piece 6.

Figure 8:
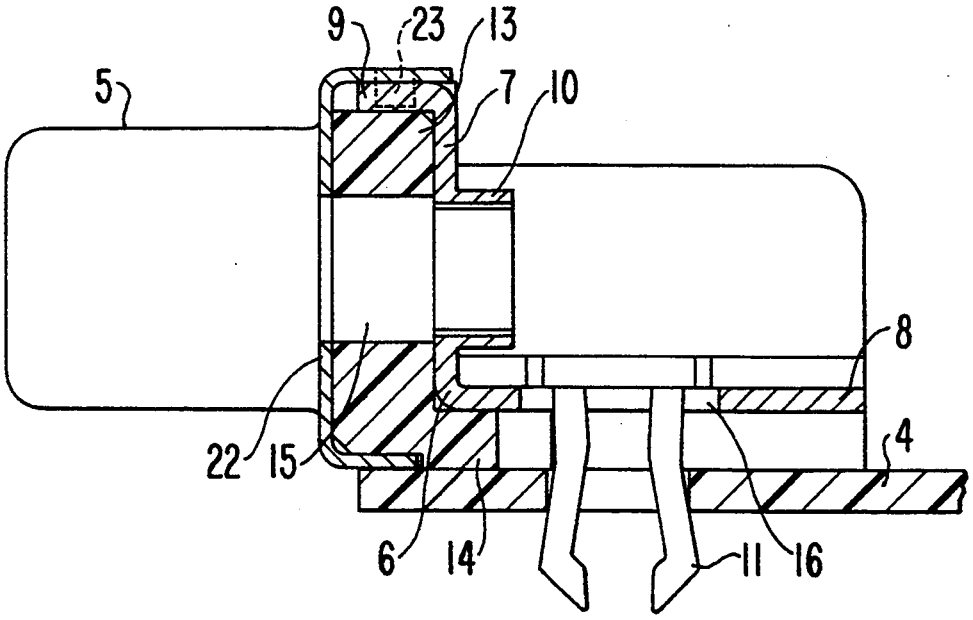
FIG. 8 is a sectional view taken on line A—A of FIG. 1.
Figure 9:
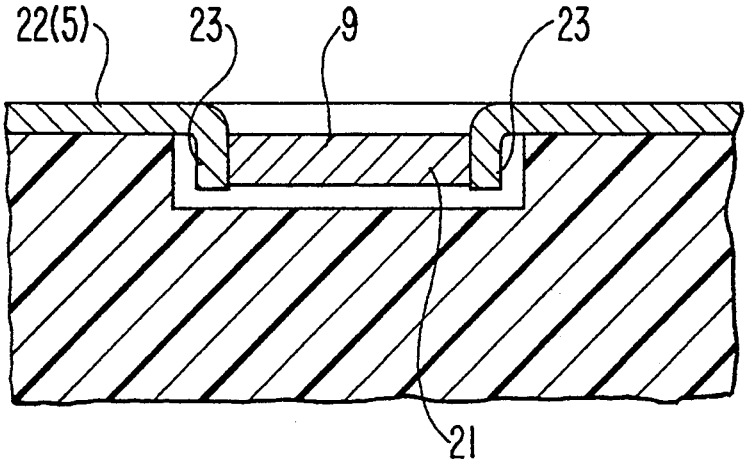
FIG. 9 is a sectional view taken on line B—B of FIG. 1.

As a modified embodiment, the metal shell 5 has at each end thereof a grounding portion 22 which is formed generally in a horizontal U-shape in section and is fit to upper and side surfaces of the supporting seat 13 of the mounting seat 12. Side plate portions **22*a*, 22*b* of the grounding portion 22 are provided with clamping elements 23 projecting inwardly. On the other hand, the supporting seat 13 is provided with a short claw receiving portion 24 opposite the side plate portion 22*a*. The receiving portion 24 opens through the seat surface of the supporting seat 13. The clamping elements 23 are positioned opposite one another along inner sidewalls of the short claw receiving portion 24. As shown in FIGS. 8 and 9, the short claw 9 of the metal grounding piece 6 is pressure-inserted into the receiving portion 24 between the clamping elements 23. The clamping elements 23 resiliently receive the short claw 9 within the receiving portion 24, and opposite side faces of the short claw 9 are brought into pressure-contact with the clamping elements 23** to provide reliable contact.

In the illustrated modified embodiment, the metal shell 5 is provided with the clamping elements 23, and the receiving port 21 for receiving the metal grounding piece 6 is aligned with the receiving portion 24 and between the clamping elements 23. The short claw 9 of the metal grounding piece 6 is pressure-inserted between the clamping elements 23 and is simultaneously pressure-inserted and positively held between the side plate portion **22*a* of the grounding portion 22 of the metal sheet 5 and the bottom wall of the receiving portion 24**.

Therefore, the above modified embodiment shows an arrangement for pressure-inserting the short claw 9 of the metal grounding piece 6 into the interface between the grounding portion 22 of the shell metal piece 5 in order to provide electrical connection between the metal shell 5 and the metal grounding piece 6. With this arrangement, the short claw 9 of the metal grounding piece 6 can be pressure-inserted between the metal shell 5 and the connector body 2 without the provision of the clamping elements 23. More specifically, an arrangement may be possible, wherein there is provided only the short claw receiving portion 24 without the clamping elements shown, for example, in FIG. 4, and this short claw receiving portion 24 is made smaller in width than the short claw 9 in order to facilitate forced pressure-insertion of the short claw 9 into the receiving portion 24. In this case, the short claw receiving portion 24 functions like the receiving portion 21 for receiving the short claw 9.

Although not illustrated, as another example, there may be provided an arrangement in which the clamping elements 23 extend outwardly from the side plate of the grounding portion 22, and the respective clamping elements 23 are bent in the shape of a hook so that the short claw 9 can be pressure-inserted therebetween.

In any of the above embodiments and/or examples, the short claw 9 of the metal grounding piece 9 is pressure-inserted into the shield connector 1 so as to be pressure-contacted with the metal shell 5.

The metal grounding piece 6 is firmly secured to the metal shell 5 and shield connector 1 through the short claw 9. However, if the threaded cylindrical sleeve 10 is provided, the metal grounding piece 6 can be more firmly secured to the shield connector 1 by use of a screw means by forming a hole 15 communicating with the threaded hole of the threaded cylindrical sleeve 10 in the supporting seat 13 and grounding portion 22.

Thus, the metal grounding piece 6 is pressure-inserted into the shield connector 1 so as to be pressure-contacted with the metal shell 6, and the contacting legs 11 are pressure-inserted into and soldered in a through-hole formed in the wiring board 4, or mounted on and connected to the wiring board 4 by a screw engaged with the threaded cylindrical sleeve 25.

According to the present invention, by pressure-inserting the short claw 9 of the grounding piece 6 into a receiving portion of the metal shell 5 or pressure-inserting the short claw 9 into the receiving portion between the metal shell and the connector body 2, there are be provided a reliable electrical connection not only between the metal shell 5 and the metal grounding piece 6 but also between the shield connector 1 and the metal grounding piece 6.

The electrical connection can be provided by means of a simple pressure-insertion of the short claw 9. Therefore, the number of assembly steps is reduced relative to the prior art where the metal grounding piece is first set in a predetermined position and must then be firmly secured by a screw means or a stud means. The problem of insufficient shielding is not encountered in the present invention. Moreover, component parts required in the prior art, such as a screw or a stud, are not required in the present invention. This, together with the reduction in the number of assembly steps, makes it possible to achieve the extensive cost reduction.

Although the invention has been described in the form of preferred embodiments, it is not limited to these embodiments and various changes and modifications can be made.

What is claimed is:

1. A shield connector comprising:

a connector body having first and second ends;

a metal shell encasing a portion of said connector body;

a metal grounding piece mounted to said first end of said connector body;

wherein said first end of said connector body has a receiving slot formed therein;

wherein said metal shell includes a pair of metal clamping elements protruding inwardly into said receiving slot of said connector body such that said metal clamping elements are disposed opposite one another; and wherein a metal claw member is integrally connected with said metal grounding piece and projects away from said metal grounding piece, and said metal claw member is disposed within said receiving slot of said connector body and is clamped between said metal clamping elements of said metal shell, such that said metal shell and said metal grounding piece are electrically connected.

2. A shield connector as recited in claim 1, wherein said receiving slot includes side walls along which said clamping elements are disposed, respectively, and a bottom wall; and said metal claw member which is clamped between said clamping elements is also press-fit between said metal shell and said bottom wall of said receiving slot.

3. A shield connector as recited in claim 1, wherein said first end of said connector body comprises an L-shaped support seat;

said metal grounding piece is L-shaped; and said metal grounding piece is mounted on said L-shaped support seat.

4. A shield connector as recited in claim 3, wherein said metal claw member is integrally connected to a first leg of said L-shaped metal grounding piece; and a second leg of said L-shaped metal grounding piece is provided with a pair of downwardly protruding grounding legs for connecting said metal grounding piece to a wiring board.

5. A shield connector as recited in claim 3, wherein said metal claw member is integrally connected to a first leg of said L-shaped metal grounding piece; and a second leg of said L-shaped metal grounding piece is provided with an internally threaded cylindrical sleeve for use in connecting said metal grounding piece to a wiring board.

6. A shield connector as recited in claim 1, wherein said metal shell comprises a grounding portion having a substantially U-shaped cross section including first and second side plate portions;

said clamping members of said metal shell project inwardly from said first side plate portion of said metal shell.

7. A shield connector as recited in claim 6, wherein said receiving slot includes side walls along which said clamping elements are disposed, respectively, and a bottom wall; and said metal claw member which is clamped between said clamping elements is also press-fit between said first side plate portion of said metal shell and said bottom wall of said receiving slot.

* * * * *